US008237649B2

(12) United States Patent
Murai

(10) Patent No.: US 8,237,649 B2
(45) Date of Patent: Aug. 7, 2012

(54) LIQUID CRYSTAL DRIVING DEVICE

(75) Inventor: Shuji Murai, Ashikaga (JP)

(73) Assignees: Semiconductor Components Industries, LLC, Phoenix, AZ (US); Sanyo Semiconductor Co., Ltd., Gunma (JP)

( * ) Notice: Subject to any disclaimer, the term of this patent is extended or adjusted under 35 U.S.C. 154(b) by 611 days.

(21) Appl. No.: 12/402,429

(22) Filed: Mar. 11, 2009

(65) Prior Publication Data

US 2009/0231258 A1 Sep. 17, 2009

(30) Foreign Application Priority Data

Mar. 13, 2008 (JP) ..... 2008-064676

(51) Int. Cl.
*G09G 5/00* (2006.01)
*G09G 3/36* (2006.01)

(52) U.S. Cl. ..... 345/98; 345/76; 345/100

(58) Field of Classification Search ..... 345/98, 345/100, 76
See application file for complete search history.

(56) References Cited

U.S. PATENT DOCUMENTS 4,988,954 A * 1/1991 Stern et al. ..... 330/264
6,392,627 B1 * 5/2002 Maekawa ..... 345/98
7,710,384 B2 * 5/2010 Azami et al. ..... 345/100
7,903,078 B2 * 3/2011 Tsuchi ..... 345/100

FOREIGN PATENT DOCUMENTS

JP 2005-321457 11/2005

OTHER PUBLICATIONS

Johns and Martin, Analog Integrated Circuit Design, 1997, John Wiley and Sons, 1st Ed., p. 128.*

Sedra and Smith, Microelectronic Circuits, 1987, Holt Rinehart and Winston, 2nd Ed., p. 870.*

Soclof, Analog Integrated Circuits, 1985, Prentice-Hall, 1st Ed., pp. 137-139.*

* cited by examiner

*Primary Examiner* — Quan-Zhen Wang

*Assistant Examiner* — Michael J Eurice

(74) *Attorney, Agent, or Firm* — SoCal IP Law Group LLP; Steven C. Sereboff; John E. Gunther

(57) ABSTRACT

A liquid crystal driving device includes, for each of a plurality of scanning lines, a level shift and output buffer circuit including a first PMOSFET and a first NMOSFET connected in series, a second PMOSFET and a second NMOSFET connected in series, and CMOS inverter circuit. A gate of the first PMOSFET and a gate of the second NMOSFET may be connected to respective bias voltages. Alternatively, a gate of the first NMOSFET and a gate of the second PMOSFET may be connected to respective bias voltages. Each level shift and output buffer circuit receives a binary input signal and outputs a buffered signal having both levels shifted with respect to the input signal using six transistors.

4 Claims, 6 Drawing Sheets

LIQUID CRYSTAL DRIVING DEVICE

CROSS-REFERENCE TO RELATED APPLICATION

This application claims the benefit of priority to Japanese Patent Application No. 2008-064676, filed Mar. 13, 2008, of which full contents are incorporated herein by reference.

BACKGROUND OF THE INVENTION

1. Field of the Invention

The present invention relates to a liquid crystal driving device.

2. Description of the Related Art

As a liquid crystal driving device that drives a liquid crystal panel including a switching element such as TFT (Thin Film Transistor) corresponding to each of a plurality of pixels disposed in a matrix form, there is generally known a liquid crystal driving device including: a scanning line driving circuit that supplies row by row a signal for performing switching control of the switching element through a scanning line connected in parallel with the gates of a plurality of switching elements of the same row; and a data line driving circuit that supplies column by column a signal corresponding to the tone of each pixel through a data line connected in parallel with sources of a plurality of switching elements of the same column. As the scanning line driving circuit, there is generally known a scanning line driving circuit including for every scanning line a level shift circuit that amplifies a binary signal of a comparatively low voltage input from a microcomputer etc., which control the scanning line driving circuit, into a binary signal of a higher voltage for performing switching control of the switching element.

In FIG. 11 of Japanese Patent Application Laid-Open Publication No. 2005-321457, as the level shift circuit used for the scanning line driving circuit, there is disclosed an example of a configuration where a High level amplifying unit that amplifies a binary signal having potentials of VD and VS (<VD) firstly into a binary signal having potentials of VH (>VD) and VS, and a Low level amplifying unit that amplifies it secondly into a binary signal having potentials of VH and VL (<VS), are connected in series, for example. Furthermore, in FIG. 2 to FIG. 4 of Japanese Patent Application Laid-Open Publication No. 2005-321457, there is disclosed an example of a configuration where a first level shifter that amplifies a binary signal having potentials of VD and VS into a binary signal having potentials of VD and VL, and a second level shifter that amplifies it to a binary signal having potentials of VH and VS, are connected in parallel, for example.

Thus, even when it is difficult to amplify from a binary signal of a comparatively low voltage directly to a binary signal of a higher voltage, a binary signal for performing switching control of the switching element through the scanning line can be supplied by employing the above series connection configuration or parallel connection configuration.

However, the above series connection configuration or parallel connection configuration have a problem that a circuit size becomes larger, as compared with the case where a binary signal input to the level shift circuit can be amplified directly to a binary signal to be output. In particular, when the microcomputer, which controls the scanning line driving circuit etc., is driven by low voltage, there is increased the case where the difference becomes large in voltage level between a binary signal input to the scanning line driving circuit from the microcomputer and a binary signal output by the scanning line driving circuit through a scanning line, and therefore, a binary signal cannot be amplified directly. Furthermore, in the scanning line driving circuit including many scanning line outputs, the circuit size of the level shift circuit provided for every scanning line has an influence, the scale of which corresponds to the number of scanning lines, on the circuit size of the whole scanning line driving circuit.

Therefore, even when it is difficult to amplify a binary signal of a comparatively low voltage directly to become a binary signal of a higher voltage, it is preferable to realize a level shift circuit with a comparatively small-scale configuration.

SUMMARY OF THE INVENTION

A liquid crystal driving device according to an aspect of the present invention, comprises: a scanning line driving circuit employed in conjunction with a data line driving circuit, the scanning line driving circuit being configured to supply switching elements included in respective pixels corresponding respectively to intersections of a plurality of scanning lines and a plurality of data lines of a liquid crystal panel with signals for performing switching control of the switching elements through the plurality of scanning lines, the data line driving circuit being a circuit configured to supply the switching elements with signals corresponding to tones of the pixels through the plurality of data lines, the scanning line driving circuit including, for each of the plurality of scanning lines, a first series circuit having a first PMOSFET and a first NMOSFET connected in series, both ends thereof being connected respectively to a point of first potential and a point of second potential, the first series circuit being configured to receive at a gate of the first PMOSFET a binary signal having two levels not higher than a level of the first potential and higher than a level of the second potential, a second series circuit having a second PMOSFET and a second NMOSFET connected in series, both ends thereof being connected respectively to a point of third potential higher than the first potential and a point of the second potential, a gate of the second NMOSFET being connected to a connection point of the first PMOSFET and the first NMOSFET, and an output buffer circuit configured to buffer a voltage of a connection point of the second PMOSFET and the second NMOSFET, and output the buffered voltage, a gate of the first NMOSFET being applied with a first bias voltage adapted such that the second NMOSFET is turned ON or turned OFF in response to a level of the binary signal, and a gate of the second PMOSFET being applied with a second bias voltage adapted such that the second PMOSFET becomes higher in on-resistance than the second NMOSFET.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

===Schematic Configuration and Operation of Whole Liquid Crystal Driving Device===

Figure 5:
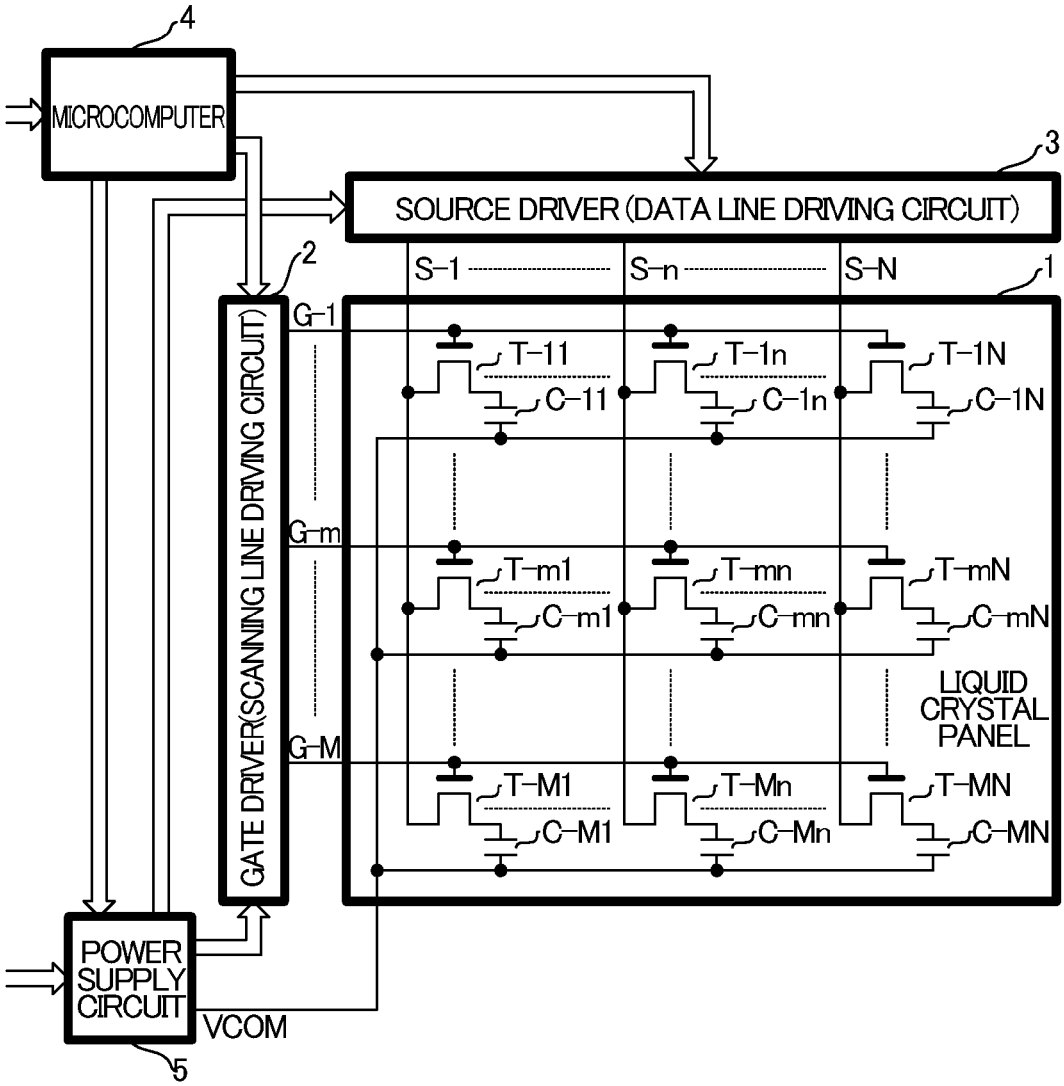
FIG. 5 is a block diagram showing a schematic configuration of a whole liquid crystal driving device to which an embodiment of the present invention is applied.

There will hereinafter be explained a schematic configuration of a whole liquid crystal driving device to which an embodiment of the present invention is applied, with reference to FIG. 5.

The liquid crystal driving device for driving a liquid crystal panel 1 includes a scanning line driving circuit 2, a data line driving circuit 3, a microcomputer 4, and a power supply circuit 5, for example.

In the liquid crystal panel 1 to be driven, pixels are arranged in a form of matrix with an M rows and N columns, for example. Each pixel includes a capacitor (C-mn) for applying a voltage which controls transmittance of a liquid crystal element (not shown), and a switching element (T-mn) whose drain is connected to the capacitor (C-mn). Here, it is assumed that M and m are natural numbers having a relationship of $1 \leqq m \leqq M$ while N and n are natural numbers having a relationship of $1 \leqq n \leqq N$, and they will hereinafter be used as such reference numerals as to be described above.

The scanning line driving circuit 2 has outputs corresponding to M number of scanning lines (G-1 to G-M), and each scanning line (G-m) is connected to the gate of N number of switching elements (T-m1 to T-mN) of the same row. Hereinafter, the scanning line driving circuit 2 that supplies a signal to the gate of a switching element (T-mn) through a scanning line (G-m) is referred to as "a gate driver 2".

The data line driving circuit 3 has outputs corresponding to N number of data lines (S-1 to S-N), and each data line (S-n) is connected to the sources of M number of switching elements (T-1*n* to T-Mn) of the same column. Hereinafter, the data line driving circuit 3 that supplies a signal to the source of a switching element (T-mn) through a data line (S-n) is referred to as "a source driver 3".

The microcomputer 4 controls the gate driver 2, the source driver 3, and the power supply circuit 5 according to a signal input from a central processing unit (not shown), etc.

The power supply circuit 5 generates various kinds of voltages used in the gate driver 2 and the source driver 3, and a counter electrode potential (VCOM) at the point connected to the capacitor (C-mn) of the liquid crystal panel 1 on the side to which the switching element (T-mn) is not connected, based on a reference voltage supplied from the outside.

An operation of the whole liquid crystal driving device will then be described.

Firstly, according to the control of the microcomputer 4, the gate driver 2 selects one scanning line (G-m), supplies a signal for turning ON only to N number of switching elements (T-m1 to T-mN) connected to the selected scanning line (G-m), and turns OFF all the switching elements connected to the scanning line which is not selected. Secondly, the source driver 3 supplies a signal corresponding to the tone of each pixel corresponding to N number of switching elements (T-m1 to T-mN) which are turned ON by the gate driver 2, according to the control of the microcomputer 4.

Thus, N number of switching elements (T-m1 to T-mN) are turned ON by the gate driver 2, and a voltage between the potential of the signal corresponding to the tone of each pixel which is supplied from the source driver 3 and the counter electrode potential (VCOM) generated in the power supply circuit 5 is applied to both ends of the capacitor (C-mn) connected to each switching element (T-mn). And then, according to the applied voltage, the transmittance of the liquid crystal element (not shown) changes and the pixels in a row are displayed. Further, the M number of scanning lines (G-1 to G-M) are sequentially selected by the gate driver 2 and the above-mentioned display of the pixels in one row is repeated, and thus, the whole pixels with M rows and N columns of the liquid crystal panel 1 are displayed.

===Schematic Configuration and Operation of Gate Driver===

Figure 6:
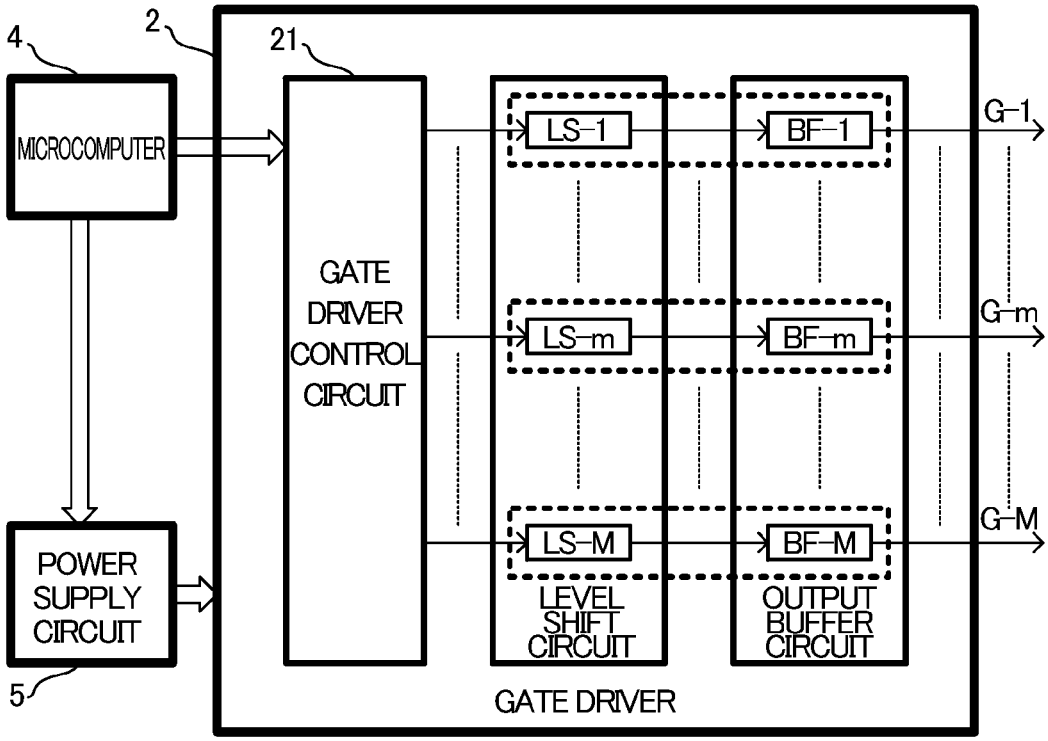
FIG. 6 is a block diagram showing a schematic configuration of a gate driver 2.

Firstly, a schematic configuration of the gate driver 2 will be described with reference to FIG. 6.

The gate driver 2 includes, for example, a gate driver control circuit 21, level shift circuits (LS-1 to LS-M), and output buffer circuits (BF-1 to BF-M).

The outputs of the gate driver control circuit 21 controlled by the microcomputer 4 is connected in parallel with the level shift circuits (LS-1 to LS-M) corresponding to the M number of scanning lines (G-1 to G-M). And then, the output of level shift circuit (LS-m) is connected in series to an output buffer circuit (BF-m), and the output of the output buffer circuit (BF-m) is connected to the scanning line (G-m) as an output of the gate driver 2.

Secondly, an operation of the gate driver 2 will be explained.

The gate driver control circuit 21 sequentially selects as to the M number of scanning lines (G-1 to G-M) with a sequential selection circuit such as a shift register, for example, about the M scanning lines (G-1 to G-M), outputs the binary signal of a level indicating a selected state to the level shift circuit (LS-m) corresponding to the selected scanning line (G-m), and outputs the binary signal of a level indicating not-selected state to all the level shift circuits corresponding to the not-selected scanning lines. The binary signal output from the gate driver control circuit 21 is input in parallel to the level shift circuits (LS-1 to LS-M), and is amplified to become the binary signal of a higher voltage for turning ON or OFF the switching element (T-mn), in each level shift circuit (LS-m). The binary signal of a higher voltage output from the level shift circuit (LS-m) is buffered in the output buffer circuit (BF-m), to be input to the gate of the switching element (T-mn) through the scanning line (G-m).

Thus, the gate driver 2 supplies the binary signal for turning ON to the gates of N number of switching elements (T-m1 to T-mN) connected to the scanning line (G-m) to be sequentially selected, and supplies the binary signal for turning OFF to the gates of the switching elements connected to the not-selected scanning line.

===Configuration and Operation of Level Shift Circuit and Output Buffer Circuit ===

First Embodiment

Figure 1:
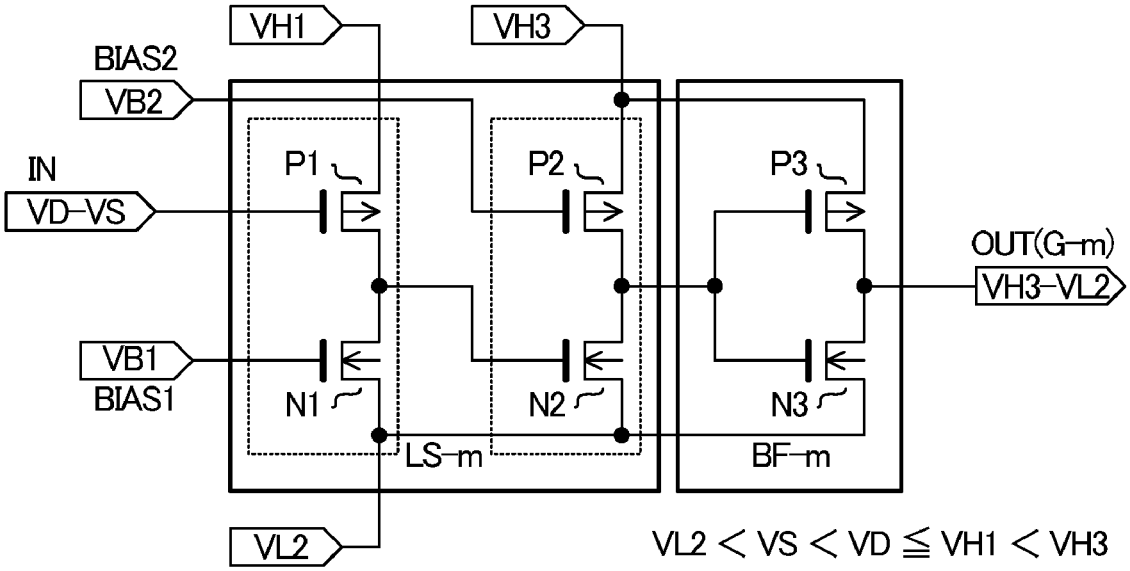
FIG. 1 is a circuit block diagram showing a configuration of a level shift circuit and an output buffer circuit of a liquid crystal driving device according to a first embodiment of the present invention.

Firstly, a configuration of a level shift circuit and an output buffer circuit according a first embodiment of a liquid crystal driving device of the present invention will be described with reference to FIG. 1. Although FIG. 1 shows a configuration of only the level shift circuit (LS-m) and the output buffer circuit (BF-m) corresponding to one scanning line (G-m), it is assumed that configurations are the same with respect to M number of scanning lines (G-1 to G-M).

In an embodiment of the present invention, the level shift circuit (LS-m) includes PMOSFETs (P-channel Metal-Oxide Semiconductor Field-effect Transistor) (P1, P2) and NMOSFETs (N-channel MOSFET) (N1, N2). In an embodiment of the present invention, the output buffer circuit (BF-m) is a CMOS (Complementary MOS) inverter circuit including a PMOSFET (P3) and an NMOSFET (N3). In an embodiment of the present invention, for example, it is assumed that when the potentials of the binary signal input to the gate of the PMOSFET (P1) are defined as VD and VS, the potential at the point connected to the source of the PMOSFET (P1) is defined as VH1, the potential at the point connected to the sources of PMOSFETs (P2, P3) is defined as VH3, and the potential at the point connected to the sources of the NMOSFETs (N1, N2, N3) is defined as VL2, the relationship thereamong is expressed by VL2<VS<VD≦VH1<VH3.

The PMOSFET (P1) and the NMOSFET (N1) are connected in series, and both ends are connected to the points of the potentials VH1 and VL2, respectively. The binary signal having potentials of VD and VS is input to the gate of the PMOSFET (P1), and the gate of the NMOSFET (N1) is connected to the point of a potential VB1 so that the bias voltage (BIAS1) of VB1-VL2 is applied to the gate of the NMOSFET (N1).

The PMOSFET (P2) and the NMOSFET (N2) are connected in series, and both ends are connected to the points of the potentials VH3 and VL2, respectively. The gate of the PMOSFET (P2) is connected to the point of a potential VB2 so that the bias voltage (BIAS2) of VB2-VH3 is applied to the gate of the PMOSFET (P2), and the gate of the NMOSFET (N2) is connected to a connection point of the PMOSFET (P1) and the NMOSFET (N1). The connection point of the PMOSFET (P2) and the NMOSFET (N2) is connected to the output buffer circuit (BF-m) as an output of the level shift circuit (LS-m).

The output buffer circuit (BF-m), which is a CMOS inverter circuit, uses a voltage between potentials VH3 and VL2 as a power supply voltage, and the output of the level shift circuit (LS-m) is connected to the gates of the PMOSFET (P3) and the NMOSFET (N3). The connection point of the PMOSFET (P3) and the NMOSFET (N3) is connected to the scanning line (G-m) as an output of the output buffer circuit (BF-m).

The bias voltage (BIAS1) applied to the gate of the NMOSFET (N1) is such a voltage that the NMOSFET (N2) is turned OFF when the potential of the binary signal input to the gate of the PMOSFET (P1) is VD which is of a high level, and NMOSFET (N2) is turned ON when the potential of the binary signal input to the gate of the PMOSFET (P1) is VS which is of a low level.

The bias voltage (BIAS2) applied to the gate of the PMOSFET (P2) is such a voltage that the on-resistance of the PMOSFET (P2) is higher than the on-resistance of the NMOSFET (N2).

Secondly, an operation of the level shift circuit and the output buffer circuit according to an embodiment of the present invention will be explained with reference to FIG. 2A and FIG. 2B.

Figure 2A:
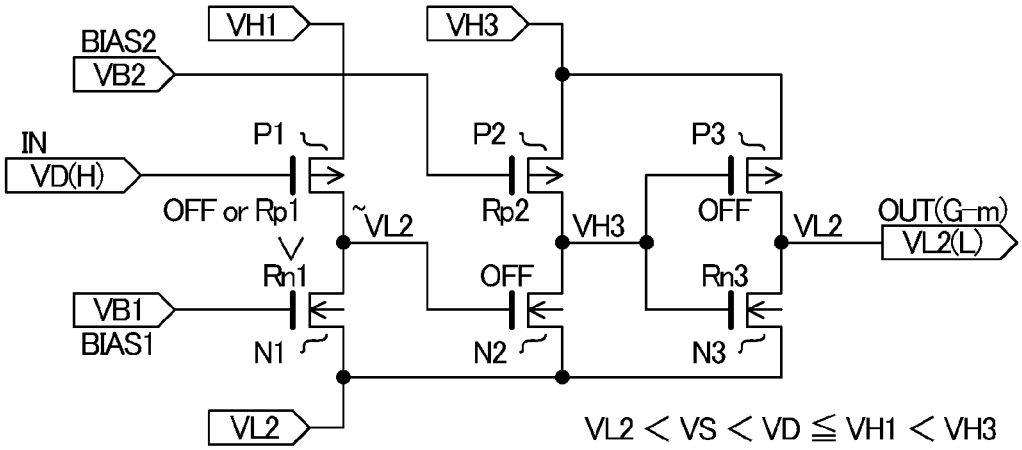
FIG. 2A is a diagram for explaining an operation of a level shift circuit and an output buffer circuit of a liquid crystal driving device according to a first embodiment of the present invention.

The case will be described where the potential of the binary signal input to the gate of PMOSFET (P1) is VD, which is of a high level, as shown in FIG. 2A.

The NMOSFET (N1) is turned ON by the bias voltage (BIAS1), and the PMOSFET (P1) is turned OFF or ON by the voltage between gate and source of VD-VH1. When the PMOSFET (P1) is turned OFF, the gate potential of the NMOSFET (N2) connected to the connection point of the PMOSFET (P1) and the NMOSFET (N1) becomes equal to a source potential VL2, and therefore, the NMOSFET (N2) is turned OFF. Even when the PMOSFET (P1) is turned ON, the bias voltage (BIAS1) is set such that the on-resistance of the PMOSFET (P1) becomes sufficiently higher than the on-resistance of the NMOSFET (N1), and the gate potential becomes close to the source potential VL2 to such an extent that the NMOSFET (N2) is turned OFF.

The PMOSFET (P2) is turned ON by the bias voltage (BIAS2). As mentioned above, since the NMOSFET (N2) is turned OFF, the output potential of the level shift circuit (LS-m) becomes equal to a source potential VH3 of the PMOSFET (P2).

Since the input potential VH3 from the level shift circuit (LS-m) to the output buffer circuit (BF-m) is equal to a power supply potential VH3 on the side of the PMOSFET (P3) of the CMOS inverter circuit, the output potential of the output buffer circuit (BF-m) becomes equal to a power supply potential VL2 on the side of the NMOSFET (N3).

Figure 2B:
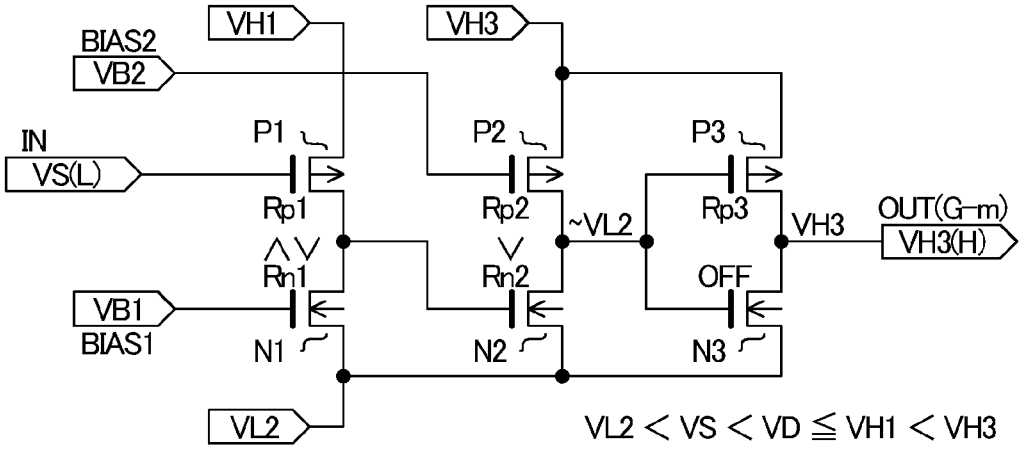
FIG. 2B is a diagram for explaining an operation of a level shift circuit and an output buffer circuit of a liquid crystal driving device according to a first embodiment of the present invention.

The case will be described where the potential of the binary signal input to the gate of the PMOSFET (P1) is VS, which is of a low level, as shown in FIG. 2B.

The NMOSFET (N1) is turned ON by bias voltage (BIAS1), and the PMOSFET (P1) is turned ON by the voltage between gate and source of VS-VH1. Although the on-resistance of the PMOSFET (P1) may be lower or higher than the on-resistance of the NMOSFET (N1), the bias voltage (BIAS1) is set to such a voltage between gate and source as to obtain at least the result that the NMOSFET (N2) is turned ON.

The PMOSFET (P2) is turned ON by the bias voltage (BIAS2) Since the bias voltage (BIAS2) is set such that the on-resistance of the PMOSFET (P2) becomes higher than the on-resistance of the NMOSFET (N2), there is obtained at least the result that the output potential of the level shift circuit (LS-m) becomes closer to the source potential VL2 of the NMOSFET (N2) than to the source potential VH3 of the PMOSFET (P2).

Since the input potential from the level shift circuit (LS-m) to the output buffer circuit (BF-m) is closer to the power supply potential VL2 on the side of the NMOSFET (N3) than the power supply potential VH3 on the side of the PMOSFET (P3) of the CMOS inverter circuit, the output potential of the output buffer circuit (BF-m) becomes close to the power supply potential VH3 on the side of the PMOSFET (P3).

In the output buffer circuit (BF-m), by connecting in series a plurality of stages of CMOS inverter circuits using the voltage between potentials VH3 and VL2 as the power supply voltage, it is possible to make the output potential equal to the power supply potential VH3 or VL2. However, more preferably, the bias voltage (BIAS2) is set such that the on-resistance of the PMOSFET (P2) becomes sufficiently higher than the on-resistance of the NMOSFET (N2), and the gate potential becomes close to the source potential VL2 to such an extent that the NMOSFET (N3) of the CMOS inverter circuit is turned OFF. In this case, the output potential of the output buffer circuit (BF-m) can be made equal to the power supply potential VH3 on the side of the PMOSFET (P3) by one stage of CMOS inverter circuit, as shown in FIG. 2B.

Thus, the level shift circuit (LS-m) and the output buffer circuit (BF-m) amplify the binary signal having potentials of VD and VS which is input from the gate driver control circuit 21 to become the binary signal of a higher voltage having the potentials of VL2 and VH3 for turning ON or OFF the switching element (T-mn), and output the amplified binary signal.

Second Embodiment

Figure 3:
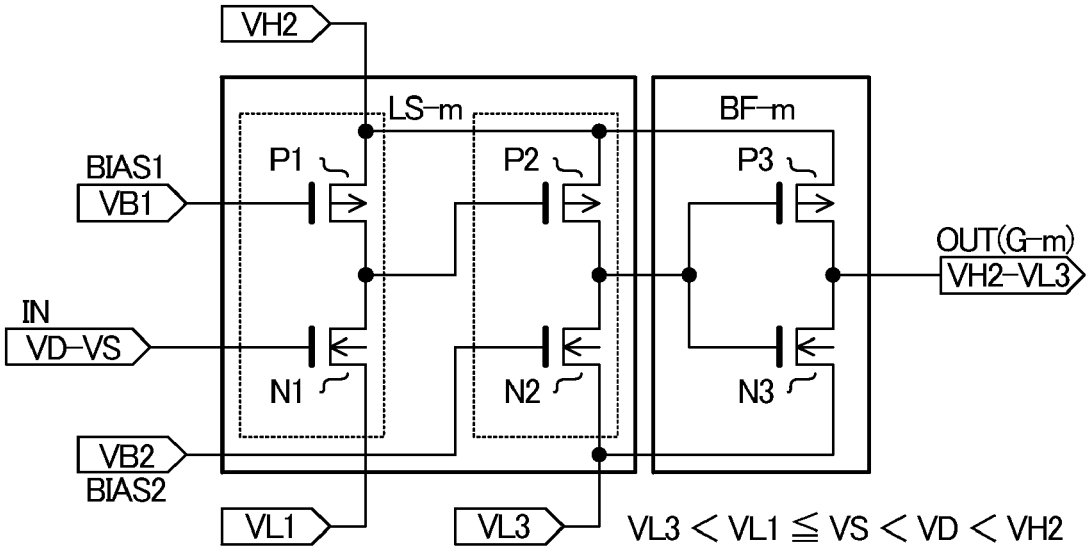
FIG. 3 is a circuit block diagram showing a configuration of a level shift circuit and an output buffer circuit of a liquid crystal driving device according to a second embodiment of the present invention.

Firstly, a configuration of a level shift circuit and an output buffer circuit according to a second embodiment of the liquid crystal driving device of the present invention will be described with reference to FIG. 3. Although FIG. 3 shows a configuration of only the level shift circuit (LS-m) and the output buffer circuit (BF-m) corresponding to one scanning line (G-m), it is assumed that configurations are the same with respect to M number of scanning lines (G-1 to G-M).

The level shift circuit (LS-m) includes PMOSFETs (P1, P2) and NMOSFETs (N1, N2), and the output buffer circuit (BF-m) is a CMOS inverter circuit including a PMOSFET (P3) and an NMOSFET (N3), as is the case with a first embodiment of the present invention. In an embodiment of the present invention, for example, it is assumed that when the potentials of the binary signal input to the gate of the NMOSFET (N1) are defined as VD and VS, the potential at the point connected to the source of the NMOSFET (N1) is defined as VL1, the potential at the point connected to the sources of the NMOSFETs (N2, N3) is defined as VL3, and the potential connected to the sources of the PMOSFETs (P1, P2, P3) is defined as VH2, the relationship thereamong is expressed by $VL3<VL1\leqq VS<VD<VH2$.

The NMOSFET (N1) and the PMOSFET (P1) are connected in series, and both ends are connected to the points of the potentials VL1 and VH2, respectively. The binary signal having potentials of VD and VS is input to the gate of the NMOSFET (N1), and the gate of the PMOSFET (P1) is connected to the point of a potential VB1 so that the bias voltage (BIAS1) of VB1-VH2 is applied to the gate of the PMOSFET (P1).

The NMOSFET (N2) and the PMOSFET (P2) are connected in series, and both ends are connected to the points of the potential VL3 and VH2, respectively. The gate of the NMOSFET (N2) is connected to the point of a potential VB2 so that the bias voltage (BIAS2) of VB2-VL3 is applied to the gate of the NMOSFET (N2), and the gate of the PMOSFET (P2) is connected to a connection point of the NMOSFET (N1) and the PMOSFET (P1). The connection point of the NMOSFET (N2) and the PMOSFET (P2) is connected to the output buffer circuit (BF-m) as an output of the level shift circuit (LS-m).

The output buffer circuit (BF-m), which is a CMOS inverter circuit, uses a voltage between potentials VH2 and VL3 as a power supply voltage, and the output of the level shift circuit (LS-m) is connected to the gates of the PMOSFET (P3) and the NMOSFET (N3). The connection point of the PMOSFET (P3) and the NMOSFET (N3) is connected to the scanning line (G-m) as an output of the output buffer circuit (BF-m).

The bias voltage (BIAS1) applied to the gate of the PMOSFET (P1) is such a voltage that the PMOSFET (P2) is turned OFF when the potential of the binary signal input to the gate of the NMOSFET (N1) is VS, which is of a low level, and the PMOSFET (P2) is turned ON when the potential of the binary signal input to the gate of the NMOSFET (N1) is VD, which is of a high level.

The bias voltage (BIAS2) applied to the gate of the NMOSFET (N2) is such a voltage that the on-resistance of the NMOSFET (N2) is higher than the on-resistance of the PMOSFET (P2).

Secondly, an operation of the level shift circuit and the output buffer circuit according to an embodiment of the present invention will be described with reference to FIG. 4A and FIG. 4B.

Figure 4A:
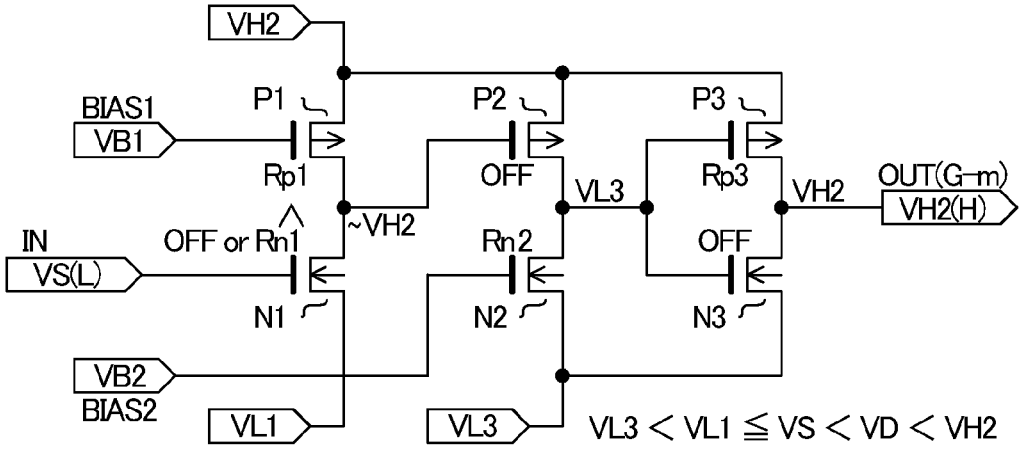
FIG. 4A is a diagram for explaining an operation of a level shift circuit and an output buffer circuit of a liquid crystal driving device according to a second embodiment of the present invention.

The case will be described where the potential of the binary signal input to the gate of the NMOSFET (N1) is VS, which is of a low level, as shown in FIG. 4A.

The PMOSFET (P1) is turned ON by the bias voltage (BIAS1), and the NMOSFET (N1) is turned OFF or ON by the voltage between gate and source of VS-VL1. When the NMOSFET (N1) is turned OFF, the gate potential of the PMOSFET (P2) at the connection point of the NMOSFET (N1) and the PMOSFET (P1) becomes equal to a source potential VH2, and therefore, the PMOSFET (P2) is turned OFF. Even when the NMOSFET (N1) is turned ON, the bias voltage (BIAS1) is set such that the on-resistance of the NMOSFET (N1) becomes sufficiently higher than the on-resistance of the PMOSFET (P1), and the gate potential becomes close to the source potential VH2 to such an extent that the PMOSFET (P2) is turned OFF.

The NMOSFET (N2) is turned ON by the bias voltage (BIAS2). As mentioned above, since the PMOSFET (P2) is turned OFF, the output potential of the level shift circuit (LS-m) becomes equal to a source potential VL3 of the NMOSFET (N2).

Since the input potential VL3 from the level shift circuit (LS-m) to the output buffer circuit (BF-m) is equal to a power supply potential VL3 on the side of the NMOSFET (N3) of the CMOS inverter circuit, the output potential of the output buffer circuit (BF-m) becomes equal to a power supply potential VH2 on the side of the PMOSFET (P3).

Figure 4B:
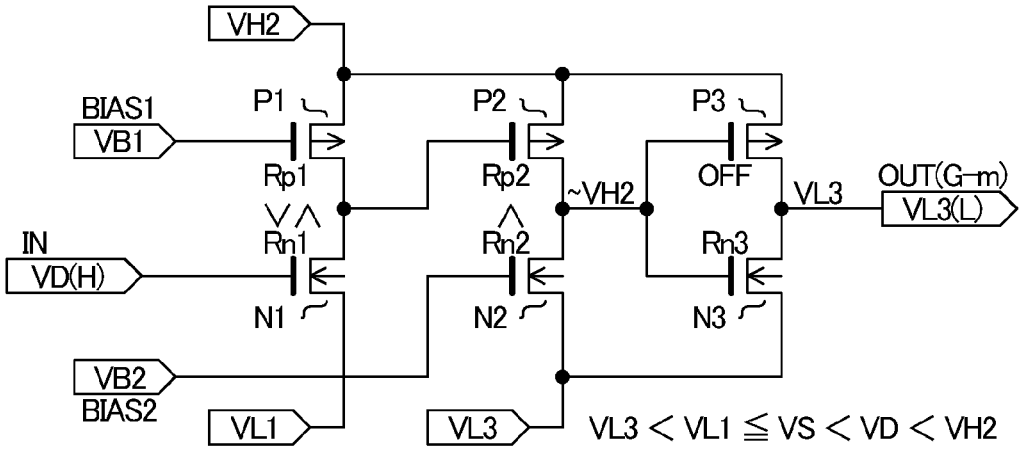
FIG. 4B is a diagram for explaining an operation of a level shift circuit and an output buffer circuit of a liquid crystal driving device according to a second embodiment of the present invention.

The case will be described where the potential of the binary signal input to the gate of the NMOSFET (N1) is VD, which is of a high level, as shown in FIG. 4B.

The PMOSFET (P1) is turned ON by bias voltage (BIAS1), and the NMOSFET (N1) is turned ON by the voltage between gate and source of VD-VL1. Although the on-resistance of the NMOSFET (N1) may be lower or may be higher than the on-resistance of the PMOSFET (P1), the bias voltage (BIAS1) is set to such a voltage between gate and source as to obtain at least the result that the PMOSFET (P2) is turned ON.

The NMOSFET (N2) is turned ON by the bias voltage (BIAS2). Since the bias voltage (BIAS2) is set such that the on-resistance of the NMOSFET (N2) becomes higher than the on-resistance of the PMOSFET (P2), there is obtained at least the result that the output potential of the level shift circuit (LS-m) becomes closer to the source potential VH2 of the PMOSFET (P2) than to the source potential VL3 of NMOSFET (N2).

Since the input potential from the level shift circuit (LS-m) to the output buffer circuit (BF-m) is closer to the power supply potential VH2 on the side of the PMOSFET (P3) than the power supply potential VL3 on the side of the NMOSFET (N3) of the CMOS inverter circuit, the output potential of the output buffer circuit (BF-m) becomes close to the power supply potential VL3 on the side of the NMOSFET (N3).

In the output buffer circuit (BF-m), by connecting in series a plurality of stages of CMOS inverter circuits using the voltage between potentials VH2 and VL3 as the power supply voltage, it is possible to make the output potential equal to the power supply potential VH2 or VL3. However, more preferably, the bias voltage (BIAS2) is set such that the on-resistance of the NMOSFET (N2) becomes sufficiently higher than the on-resistance of the PMOSFET (P2), and the gate potential becomes close to the source potential VH2 to such an extent that the PMOSFET (P3) of the CMOS inverter circuit is turned OFF. In this case, the output potential of the output buffer circuit (BF-m) can be made equal to the power supply potential VL3 on the side of the NMOSFET (N3) by one stage of CMOS inverter circuit, as shown in FIG. 4B.

Thus, the level shift circuit (LS-m) and the output buffer circuit (BF-m) amplify the binary signal having potentials of VD and VS which is input from the gate driver control circuit 21 to become the binary signal of the higher voltage having the potentials of VL3 and VH2 for turning ON or OFF the switching element (T-mn), and output the amplified binary signal.

As mentioned above, in the level shift circuit (LS-m) included for every scanning line (G-m) in the gate driver 2 of the liquid crystal driving device shown in FIG. 1: the both ends of the series connection of the PMOSFET (P1) having the gate to which the binary signal having potentials of VD and VS is input, and the NMOSFET (N1) having the gate to which the bias voltage (BIAS1) is applied, are connected to the points of the potentials VH1 and VL2, respectively; the both ends of the series connection of the PMOSFET (P2) having the gate to which the bias voltage (BIAS2) is applied, and the NMOSFET (N2) having the gate connected to the connection point of the PMOSFET (P1) and NMOSFET (N1), are connected to the potentials VH3 and VL2, respectively; the bias voltage (BIAS1) is rendered such a voltage that the NMOSFET (N2) is turned OFF when the potential of the binary signal is VD and the NMOSFET (N2) is turned ON when the potential of the binary signal is VS; and the bias voltage (BIAS2) is rendered such a voltage that the on-resistance of the PMOSFET (P2) is higher than the on-resistance of NMOSFET (N2); and thereby, there can be realized the level shift circuit (LS-m) having a comparatively small-scale configuration, so that there can be reduced the circuit size of the liquid crystal driving device including the gate driver 2.

As shown in FIG. 3, the level shift circuit (LS-m) has such a configuration that the polarity therein is reversed with respect to the polarity in the circuit in FIG. 1, and thereby, there can also be reduced the circuit size of the liquid crystal driving device including the gate driver 2.

As shown in FIG. 1 and FIG. 3, the output buffer circuit (BF-m) to which the output of the level shift circuit (LS-m) is input is rendered the CMOS inverter circuit using a voltage between source potentials of the PMOSFET (P1) and the NMOSFET (N1) in the level shift circuit (LS-m) as a power supply voltage, and thereby, there can be realized the output buffer circuit (BF-m) having a comparatively small-scale configuration, so that there can be further reduced the circuit size of the liquid crystal driving device including the gate driver 2.

In embodiments of the present invention as mentioned above, although the liquid crystal driving device for driving the liquid crystal panel 1 includes the gate driver 2, the source driver 3, the microcomputer 4, and the power supply circuit 5, it is not limitative. Although the liquid crystal driving device according to an embodiment of the present invention includes the gate driver 2 as an essential constituent, it is arbitrary whether the source driver 3, the microcomputer 4, and the power supply circuit 5 are included in the liquid crystal driving device as constituents or excluded therefrom as external devices.

In embodiments of the present invention as mentioned above, although the gate driver 2 includes the gate driver control circuit 21, the level shift circuit (LS-m), and the output buffer circuit (BF-m), it is not limitative. Although the gate driver of the liquid crystal driving device according to an embodiment of the present invention includes the level shift circuit (LS-m) and the output buffer circuit (BF-m) as essential constituents, it is arbitrary whether the gate driver control circuit 21 is included in the gate driver 2 or included in the microcomputer 4.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A liquid crystal driving device comprising:

a scanning line driving circuit employed in conjunction with a data line driving circuit, the scanning line driving circuit being configured to supply switching elements included in respective pixels corresponding respectively to intersections of a plurality of scanning lines and a plurality of data lines of a liquid crystal panel with signals for performing switching control of the switching elements through the plurality of scanning lines, the data line driving circuit being a circuit configured to supply the switching elements with signals corresponding to tones of the pixels through the plurality of data lines, the scanning line driving circuit including, for each of the plurality of scanning lines, a first series circuit having a first PMOSFET and a first NMOSFET connected in series, both ends thereof being connected respectively to a point of first potential and a point of second potential, the first series circuit being configured to receive at a gate of the first PMOSFET a binary signal having two levels not higher than a level of the first potential and higher than a level of the second potential, a second series circuit having a second PMOSFET and a second NMOSFET connected in series, both ends thereof being connected respectively to a point of third potential higher than the first potential and a point of the second potential, a gate of the second NMOSFET being connected to a connection point of the first PMOSFET and the first NMOSFET, and a CMOS inverter circuit, the CMOS inverter circuit being applied with a voltage between the second potential and the third potential as a power supply voltage and configured to receive a voltage of a connection point of the second PMOSFET and the second NMOSFET, a gate of the first NMOSFET being applied with a predetermined first bias voltage adapted such that the second NMOSFET is turned ON or turned OFF in response to a level of the binary signal, and a gate of the second PMOSFET being applied with a predetermined second bias voltage adapted such that the second PMOSFET becomes higher in on-resistance than the second NMOSFET.

2. A liquid crystal driving device comprising:

a scanning line driving circuit employed in conjunction with a data line driving circuit, the scanning line driving circuit being configured to supply switching elements included in respective pixels corresponding respectively to intersections of a plurality of scanning lines and a plurality of data lines of a liquid crystal panel with signals for performing switching control of the switching elements through the plurality of scanning lines, the data line driving circuit being a circuit configured to supply the switching elements with signals corresponding to tones of the pixels through the plurality of data lines, the scanning line driving circuit including, for each of the plurality of scanning lines, a first series circuit having a first NMOSFET and a first PMOSFET connected in series, both ends thereof being connected respectively to a point of first potential and a point of second potential, the first series circuit being configured to receive at a gate of the first NMOSFET a binary signal having two levels not lower than a level of the first potential and lower than a level of the second potential, a second series circuit having a second NMOSFET and a second PMOSFET connected in series, both ends thereof being connected respectively to a point of third potential lower than the first potential and a point of the second potential, a gate of the second PMOSFET being connected to a connection point of the first NMOSFET and the first PMOSFET, and a CMOS inverter circuit, the CMOS inverter circuit being applied with a voltage between the second potential and the third potential as a power supply voltage and configured to receive a voltage of a connection point of the second PMOSFET and the second NMOSFET, a gate of the first PMOSFET being applied with a predetermined first bias voltage adapted such that the second PMOSFET is turned ON or turned OFF in response to a level of the binary signal, and a gate of the second NMOSFET being applied with a predetermined second bias voltage adapted such that the second NMOSFET becomes higher in on-resistance than the second PMOSFET.

3. The liquid crystal driving device of claim 1, wherein the gate of the first NMOSFET is applied with the predetermined first bias voltage adapted such that the second NMOSFET is turned OFF when the level of the binary signal is a high level, and the second NMOSFET is turned ON when the level of the binary signal is a low level, and wherein the gate of the second PMOSFET is applied with the predetermined second bias voltage adapted such that the second PMOSFET becomes higher in on-resistance than the second NMOSFET when the second NMOSFET is turned ON.

4. The liquid crystal driving device of claim 2, wherein the gate of the first PMOSFET is applied with the predetermined first bias voltage adapted such that the second PMOSFET is turned ON when the level of the binary signal is a high level, and the second PMOSFET is turned OFF when the level of the binary signal is a low level, and wherein the gate of the second NMOSFET is applied with the predetermined second bias voltage adapted such that the second NMOSFET becomes higher in on-resistance than the second PMOSFET when the second PMOSFET is turned ON.

* * * * *